United States Patent [19]

Abdulally

[11] Patent Number: 5,022,893

[45] Date of Patent: Jun. 11, 1991

[54] FLUIDIZED BED STEAM TEMPERATURE ENHANCEMENT SYSTEM

[75] Inventor: Iqbal F. Abdulally, Randolph, N.J.

[73] Assignee: Foster Wheeler Energy Corporation, Clinton, N.J.

[21] Appl. No.: 489,314

[22] Filed: Mar. 1, 1990

[51] Int. Cl.[5] ..... C10S 3/56

[52] U.S. Cl. ..... 48/76; 48/77; 110/216; 110/263; 122/4 D; 422/145; 422/146; 422/147

[58] Field of Search ..... 48/76, 67, DIG. 4, 77, 48/63; 422/146, 147, 140; 122/4 D; 110/245, 216, 263; 165/104.16

[56] References Cited

U.S. PATENT DOCUMENTS

| | | | |
|---|---|---|---|
| 2,677,603 | 5/1954 | Van Loon | 48/76 |
| 4,160,009 | 7/1979 | Hamabe | 122/4 D |
| 4,522,154 | 6/1985 | Taylor et al. | 122/4 D |
| 4,665,865 | 5/1987 | Zubrod | 122/4 D |
| 4,741,290 | 5/1988 | Krieger et al. | 122/4 D |
| 4,809,623 | 3/1989 | Garcia-Mallol | 122/4 D |
| 4,896,717 | 1/1990 | Campbell et al. | 110/245 |
| 4,936,770 | 6/1990 | Abdulally | 122/4 D |
| 4,947,804 | 8/1990 | Abdulally | 122/4 D |

*Primary Examiner*—Peter Kratz
*Attorney, Agent, or Firm*—Marvin A. Naigur

[57] ABSTRACT

A reactor in which a furnace and a heat recovery area are provided. A bed of solid particulate material including fuel is supported in the furnace and air is introduced into the bed at a velocity sufficient to fluidize same and support the combustion or gasification of the fuel. The products of combustion (or flue gases) pass upwardly through the furnace and transfer heat energy to the walls thereof to produce steam. Flue gases leaving the upper region of the furnace section are transported to a heat recovery area, which functions to remove additional heat energy from the flue gases for producing the steam. A flue gas by-pass system is provided which transports relatively hot flue gases from a lower region of the furnace section to the heat recovery area for improving isothermal operating conditions and optimizing reactor performance. One or more conduits pass flue gases directly from selected extraction points within the lower region of the furnace to an upper portion of the heat recovery area. A dust collector may be connected to the gas extraction conduits for separating particulate material from the flue gases, if needed.

8 Claims, 1 Drawing Sheet

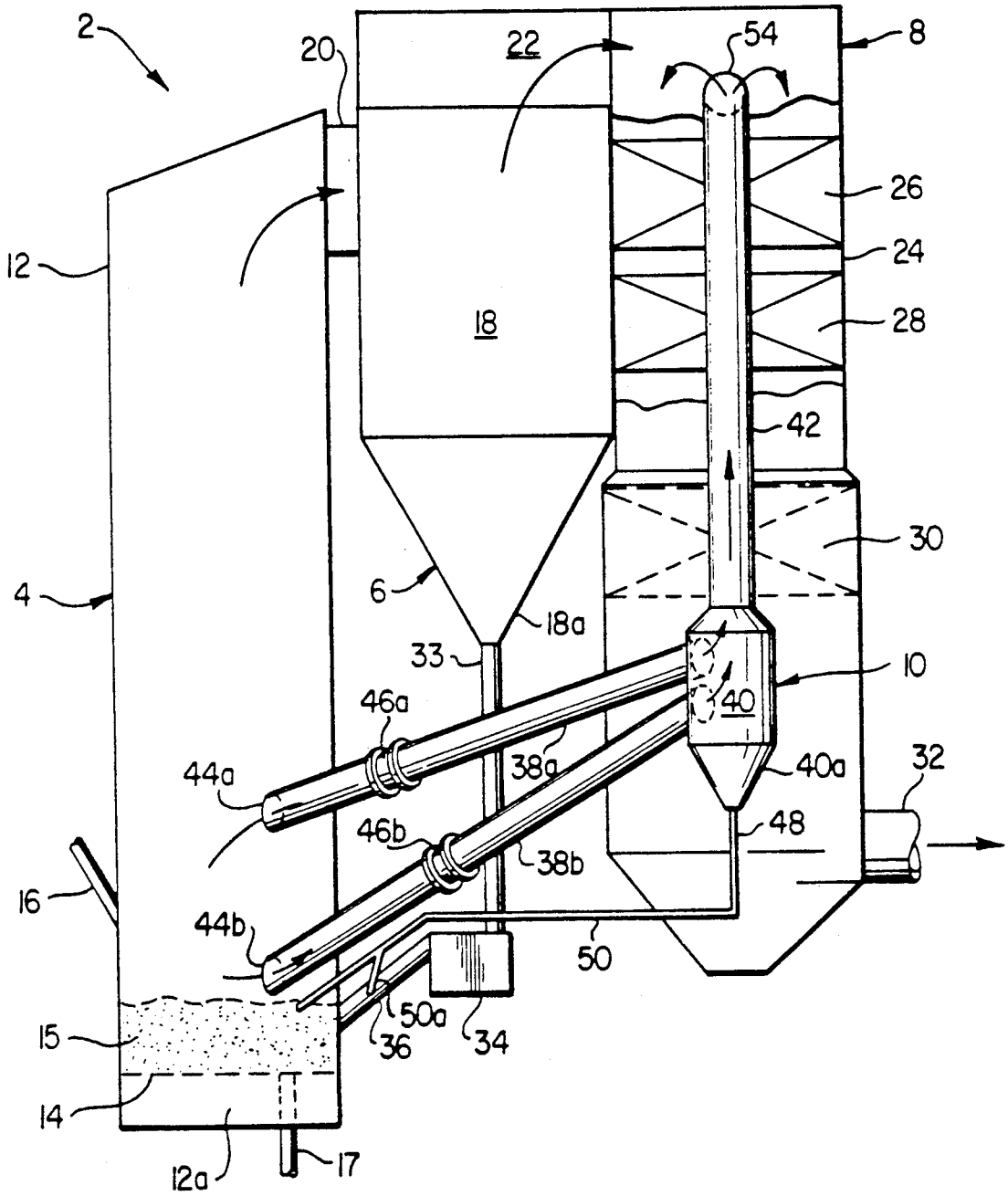
2
20
22
54
8
26
24
12
18
28
42
30
4
6
18a
33
10
46a
40
38a
44a
40a
32
46b
48
38b
16
44b
50
50a
15
36
34
14
12a
17

FLUIDIZED BED STEAM TEMPERATURE ENHANCEMENT SYSTEM

BACKGROUND OF THE INVENTION

This invention relates to a fluidized bed reactor and a method of operating same and, more particularly, to such a reactor and method in which a flue gas by-pass system is provided for channeling a portion of flue gases to a heat recovery area.

Fluidized bed reactors, such as qualifiers, steam generators, combustors, and the like are well known. In these arrangements, air is passed through a bed of particulate material, including a fossil fuel such as coal and an absorbent for the sulfur generated as a result of combustion of the coal, to fluidize the bed and promote the combustion of the fuel at a relatively low temperature. The entrained particulate solids are separated externally of the bed and recycled back into the bed. The heat produced by the fluidized bed is utilized in various applications such as the generation of steam, which results in an attractive combination of high heat release, high sulfur absorbtion, low nitrogen oxides, emissions and fuel flexibility.

The most typical fluidized bed reactor is commonly referred to as a "bubbling" fluidized bed in which the bed of particulate material has a relatively high density and a well defined, or discrete, upper surface.

Other types of fluidized bed reactors utilize a "circulating" fluidized bed in which the fluidized bed density is well below that of a typical bubbling fluidized bed, the air velocity is greater than that of a bubbling bed and the flue gases passing through the bed entrain a substantial amount of particulate solids and are substantially saturated therewith.

Also, circulating fluidized beds are characterized by relatively high solids recycling which makes them insensitive to fuel heat release patterns, thus minimizing temperature variations, and therefore stabilizing the emissions at a low level. The high solids recycling improves the efficiency of the mechanical device used to separate the gas from the solids for solids recycle, and the resulting increase in sulfur absorbent and fuel residence times reduces the absorbent fuel consumption. However, several problems do exist in connection with these types of fluidized bed reactors, and more particularly, those of the circulating type. For example, a circulating fluidized bed reactor typically must be designed to function at near isothermal conditions within a fairly precise and narrow range of temperatures for maximum sulfur capture and solids stabilization. When operating at a relatively low load, it is very difficult to maintain these temperature conditions since the flue gas temperature leaving the furnace section and entering the heat recovery area tends to drop significantly. The furnace exit flue gases become cooled to the point where the efficiency of the downstream convection heat exchange surfaces suffer and thus more elaborate or extra surfaces are required. A superheater so modified, in addition to requiring larger and more expensive superheat and/or reheat surfacing, also produces undesirably large attemperation requirements at full load. In order to maintain acceptable temperatures during operation of these modified superheaters, recycle solid stream temperature and flow control techniques, variable external heat exchangers and other expensive means of temperature control have also been employed.

However, the addition of these components also adds to the cost and complexity of the system.

SUMMARY OF THE INVENTION

It is therefore an object of the present invention to provide a fluidized bed reactor and method for controlling same which overcomes the aforementioned disadvantages of previous techniques.

It is a further object of the present invention to provide a reactor and method of the above type which provides higher flue gas temperatures to the heat recovery area, especially at low loads.

It is a still further object of the present invention to provide a reactor and method of the above type in which unusually large superheater surfacing and/or otherwise expensive means of temperature control normally required at low loads is eliminated.

It is a still further object of the present invention to provide a reactor and method of the above type in which the efficiency of the heat exchange surfaces is increased.

It is a still further object of the present invention to provide a reactor and method of the above type in which optimum system temperatures are achieved.

Toward the fulfillment of these and other objects, the fluidized bed reactor of the present invention includes a flue gas by-pass system operative between a furnace section and a heat recovery area of the reactor. One or more conduits channel a portion of the flue gases from a lower region of the furnace section above a dense bed directly to the heat recovery area of the reactor. The comparatively hot flue gases passing through the one or more conduits and received within the heat recovery area enhance the steam/reheat temperatures, especially at low loads.

BRIEF DESCRIPTION OF THE DRAWINGS

The above description, as well as further objects, features and advantages of the present invention, will be more fully appreciated by reference to the following detailed description of the presently preferred, but nonetheless illustrative, embodiments in accordance with the present invention when taken in conjunction with the accompanying drawing which is a schematic, vertical sectional, view depicting the system of the present invention.

DESCRIPTION OF THE PREFERRED EMBODIMENT

Referring specifically to the drawing, the reference numeral 2 refers, in general, to a fluidized bed reactor which includes a furnace section 4, a separating section 6, a heat recovery area 8 and a flue by-pass assembly 10. The furnace section 4 includes an upright enclosure 12 and an air plenum 12*a* disposed at the lower end portion of the enclosure for receiving air from an external source. An air distributor 14 is provided at the interface between the lower end of the enclosure 12 and the air plenum 12*a* for allowing the pressurized air from the plenum to pass upwardly through the enclosure 12. A dense bed 15 of particulate material is supported on the air distributor 14, one or more inlets 16 are provided through a front wall of the enclosure 12 for introducing a particulate material onto the bed, and a drain pipe 17 resisters with an opening in the air distributor 14 for discharging spent particulate material from the bed 15. The particulate material can include coal and relatively fine particles of an adsorbent material, such as limestone, for adsorbing the sulfur generated during the combustion of the coal, in a known manner. The air from the plenum 12*a* fluidizes the particulate material in the bed 15.

It is understood that the walls of the enclosure 12 include a plurality of water tubes (not shown) disposed in a vertically extending relationship and that flow circuitry (also not shown) is provided to pass water through the tubes to convert the water to steam. Since these types of walls and flow circuitry are conventional, they will not be described in any further detail.

The separating section 6 includes one or more cyclone separator 18 provided adjacent the enclosure 10 and connected thereto by ducts 20 which extend from openings formed in the upper portion of the rear wall of the enclosure 12 to inlet openings formed in the upper portion of the separators 18. The separators 18 receive the flue gases and entrained particulate material from the fluidized bed 15 in the enclosure 12 and operate in a conventional manner to disengage the particulate material from the flue gases due to the centrifugal forces created in the separator. The separated flue gases pass, via one or more ducts 22, into and through the heat recovery area 8 under the control of a sliding gate valve, or damper 23, associated with the duct 22.

The heat recovery area 8 includes an enclosure 24 housing a superheater 26, a reheater 28 and an economizer 30, all of which are formed by a plurality of heat exchange tubes (not shown) extending in the path of the gases that pass through the enclosure 24. The superheater 26, the reheater 28 and the economizer 30 all are connected to the aforementioned fluid flow circuitry (also not shown) extending from the tubes forming the walls of the furnace section 12 to receive heated water or vapor for further heating. After passing through the superheater 26, the reheater 28 and the economizer 30, the gases exit the enclosure 24 through an outlet 32 formed in the rear wall thereof.

The separated solids from the separator 18 pass into a hopper 18*a* connected to the lower end of the separator and then into a dipleg 33 connected to the outlet of the hopper. The dipleg 33 extends into a relatively small fluidized seal pot 34 having a discharge conduit 36 extending into the lower portion of the furnace section 4 for reasons to be described later.

The flue by-pass assembly 10 of the present invention includes two gas extraction conduits 38*a*, 38*b*, a dust collector 40 and a gas introduction conduit 42. The gas extraction conduits 38*a*, 38*b* extend through the rear wall of the enclosure 12 and communicate with the lower region of the furnace section 4. It is understood that the conduits 38*a* and 38*b* may optionally extend further into the furnace section 4 to an area generally above the dense bed 15.

The dust collector 40 is located in the lower portion of the enclosure 24 and the conduits 38*a* and 38*b* extend through a wall of the enclosure 24 in registery with the dust collector 40. Thus a portion of the furnace gases enter the conduits 38*a* and 38*b*, pass through the conduits and are discharged into the dust collector 40. It is understood that each of the conduits 38*a* and 38*b* may include grillwork or other means (not shown) for filtering or otherwise controlling the passage of material through the assembly 10. Suitable dampers 46*a*, 46*b* are also included within gas extraction conduits 38*a*, 38*b*, respectively, to control and/or prevent the passage of furnace flue gases through the flue by-pass assembly 10.

The dust collector 40 may include one or more separators (not shown) which receive the flue gases and entrained particulate material from the furnace section 4 through the conduits 38*a*, 38*b* and operates in a conventional manner to disengage the particulate material from the flue gases. The separated particulate material passes into a hopper 40*a* connected to the lower end of the dust collector 40 and then into a dipleg 48 connected to the outlet of the hopper. The dipleg 48 is connected to an injector conduit 50 having a branch conduit 50*a*. The conduits 50 and 50*a* extend through the rear wall of the enclosure 12 and to the conduit 36, respectively, for introducing the material into the bed 15 and the discharge conduit 36, respectively. The separated flue gases pass upwardly through the dust collector 40 and into the gas introduction conduit 42.

The gas introduction conduit 42 registers with the upper portion of the dust collector 40 and extends for the length of the enclosure 24 to an upper portion of the heat recovery area 8. An outlet opening is provided in the upper end portion of the conduit 42 so that gases from the furnace pass through the assembly 10 and are discharged into the upper portion of the heat recovery area 8 through the upper end of the conduit 42.

In operation, particulate fuel material from the inlet 16 is introduced into a lower region of the enclosure 12 and adsorbent material can also be introduced in a similar manner, as needed. Pressurized air from an external source passes into and through the air plenum 12*a*, through the air distributor 14 and into the bed 15 of particulate material in the enclosure 12 to fluidize the material.

A lightoff burner (not shown) or the like is disposed in the enclosure 12 and is fired to ignite the particulate fuel material. When the temperature of the material reaches a relatively high level, additional fuel from the inlet 16 is discharged into the enclosure 12.

The material in the enclosure 12 is self combusted by the heat in the furnace section 4 and the mixture of air and gaseous products of combustion (also referred to as "flue gases") passes upwardly through the enclosure 12 by natural convection and entrains, or elutriates, the relatively fine particulate material in the enclosure. The velocity of the air introduced, via the air plenum 12*a*, through the air distributor 14 and into the interior of the enclosure 12 is established in accordance with the size of the particulate material in the enclosure 12 so that a circulating fluidized bed is formed, i.e. the particulate material is fluidized to an extent that substantial entrainment or elutriation of the particulate material in the bed is achieved. Thus, the flue gases passing into an upper region of the enclosure 12 are substantially saturated with the particulate material. The saturated flue gases passing into the upper region of the enclosure 12 exit through the ducts 20 and pass into the cyclone separators 18.

As the relatively hot flue gases pass upwardly from the lower region of the furnace 4 to the upper region thereof, heat energy is radiated or conducted to the water tubes of the enclosure 12. The flue gases in the upper region of the furnace section 4 which pass to the separating section 6 and the heat recovery area 8 will therefore experience a reduction in temperature. This temperature reduction may be especially significant when the reactor 2 is operating at low fuel loads.

Once the flue gases have passed from the upper region of the furnace section 8 and into the separators 18, the solid particulate material is separated from the flue gases and the former passes through the hoppers 18*a* and is injected, via the dipleg 33, into the seal pot 34. The cleaned flue gases from the separators 18 exit, via duct 22, to the heat recovery area 8 with the valve 23 regulating the flow thereof. The flue gases pass through the enclosure 24 and across the superheater 26, the reheater 28 and the economizer 30, before exiting through the outlet 32 to external equipment.

A portion of the flue gases passing upwardly through the enclosure 12 are intercepted at one or more selected extraction points within the lower region of the enclosure 12 just above the dense bed 15 by the conduits 38*a* and 38*b* of the flue by-pass assembly 10 for direct introduction to dust collector 40. Within the dust collector 40, solid particulate material is separated from the flue gases and the former passes through the hopper 40*a* and is injected, via the dipleg 48, into injector line 50. The particulate material is then reintroduced to the dense bed 15 for additional combustion via the line 50, or via the branch line 50*a* and the conduit 36.

The cleaned flue gases from the dust collector 40 pass upwardly through gas introduction conduit 42 and exit into the upper portion of the heat recovery area 8. This flow of the relatively hot flue gases into the heat recovery area 24 through the flue by-pass assembly 10 may be regulated by adjustment of the dampers 46*a*, 46*b*. The relatively hot flue gases discharging into the upper portion of the heat recovery area 8 combine with the flue gases from the ducts 22 and pass across the superheater 26, the reheater 28 and the economizer 30, as described above.

Water is passed through the economizer 30, to a steam drum (not shown), then through the walls of the furnace section 4 to exchange heat with the fluidized bed 15 and generate steam. The steam then passes through the above-mentioned fluid flow circuitry (not shown) and through the superheater 26, the reheater 28 and the economizer 30 in the heat recovery area 8. The steam thus picks up additional heat from the hot gases passing through the heat recovery area 8 before the steam is discharged to external equipment such as a steam turbine.

It is apparent that several advantages result from the foregoing. The by-pass of relatively hot flue gases through the flue gas assembly to the heat recovery area provides for generally higher gas temperatures in the heat recovery area, and hence enhanced steam temperatures, especially at low loads. Isothermal reactor conditions which are especially difficult to maintain at low operating loads of the reactor can be economically and efficiently maintained and regulated by the flue by-pass assembly. Further, the need for larger and more expensive superheater and/or reheater surfacing is eliminated and the efficiency of the downstream heat exchange surfaces is increased.

Several variations may be made in the foregoing without departing from the scope of the invention. For example, it is contemplated that one or any number of gas extraction conduits may be provided according to the requirements of the system, there being described herein the two conduits 38*a*, 38*b* for purposes of illustration. It is also understood that the selection and number of the extraction points and thus the positioning and number of the gas extraction conduits may vary according to the particular design requirements of the reactor.

A latitude of modification, change and substitution is intended in the foregoing disclosure and in some instances, some features of the invention will be employed without a corresponding use of other features. Accordingly, it is appropriate that the appended claims be construed broadly and in a manner consistent with the scope of the invention.

What is claimed is:

1. A fluidized bed reactor comprising a furnace section for containing solid particulate material including fuel and having an upper region located above the middle of said furnace section and a lower region located below the middle of said furnace section, a heat recovery section, means for introducing air into said lower region of said furnace section at a sufficient velocity to fluidize said particulate material and support combustion or gasification of said fuel to produce flue gases, a portion of which rises to said upper region of said furnace section, means for directing said flue gases from said upper region of said furnace section to said heat recovery section, and flue gas by-pass means extending from said lower region of said furnace section to said heat recovery section for directing the remaining portion of said flue gases from said lower region of said furnace section directly to said heat recovery section.

2. The reactor of claim 1 wherein said flue gas by-pass means includes one or more conduits in communication with said lower region of said furnace section, each of said conduits having means for receiving said flue gases and being positioned at a selected location above said bed means.

3. The reactor of claim 2 wherein said conduits are also in communication with said heat recovery section.

4. The reactor of claim 4 wherein said flue gas by-pass means includes dust collector means connected to said conduits for separating entrained particulate material from said flue gases.

5. The reactor of claim 4 further comprising injector means for reintroducing the separated entrained particulate material from said dust collector into said furnace section.

6. The reactor of claim 1 wherein said flue gas by-pass means includes a damper means for regulating the volume of passage of said flue gases from said furnace section into said heat recovery section.

7. The reactor of claim 1 wherein said directing means includes separator means for separating entrained particulate material from said flue gases.

8. The reactor of claim 7 further comprising injector means for reintroducing the separated entrained particulate material from said separator means into said furnace section.

* * * * *